US005423733A

United States Patent [19]

Adachi

[11] Patent Number: 5,423,733

[45] Date of Patent: Jun. 13, 1995

[54] METHOD OF AND APPARATUS FOR MANUFACTURING PILED-UP COTTON MAT

[75] Inventor: Souichi Adachi, Tokyo, Japan

[73] Assignee: Sanei-Kisetsu Co., Ltd., Tokyo, Japan

[21] Appl. No.: 262,669

[22] Filed: Jun. 20, 1994

[30] Foreign Application Priority Data

Jun. 21, 1993 [JP] Japan ..... 5-173750

[51] Int. Cl.[6] ..... B65H 45/20

[52] U.S. Cl. ..... 493/414; 493/413; 493/411

[58] Field of Search ..... 493/411, 412, 413, 414, 493/415; 270/39

[56] References Cited

U.S. PATENT DOCUMENTS

| | | | |
|---|---|---|---|
| 1,832,556 | 11/1931 | Jensen | 493/415 |
| 2,710,992 | 6/1955 | Goldman | 19/161 |
| 3,222,730 | 12/1965 | Kalwaites | 19/163 |
| 3,770,264 | 11/1973 | Sturman | 493/413 |
| 4,074,901 | 2/1978 | Catallo | 493/413 |
| 4,493,689 | 1/1985 | Affupper | 493/411 |
| 4,573,958 | 3/1986 | Biesinger | 493/413 |
| 5,007,623 | 4/1991 | Unkuri | 493/411 |

FOREIGN PATENT DOCUMENTS

| | | | |
|---|---|---|---|
| 3501897 | 7/1986 | Denmark | 493/412 |
| 0528348A1 | 2/1993 | European Pat. Off. . | |
| 2117703 | 7/1972 | France . | |
| 4127172 | 2/1993 | Germany . | |
| WO88/03121 | 5/1988 | WIPO . | |
| WO88/03509 | 5/1988 | WIPO . | |

*Primary Examiner*—Jack W. Lavinder

*Attorney, Agent, or Firm*—Flynn, Thiel, Boutell & Tanis

[57] ABSTRACT

A conveying mechanism 11 conveys a mat material M along a first conveying path 11A and then downwardly along a second conveying path 11B while holding the material M between first and second conveyor belts 20, 30. The second conveying path 11B oscillates about a fulcrum defined by a downstream point 23A on the first conveying path 11A. A reciprocating mechanism 70 causes a substantially horizontal reciprocating motion of the discharge end of the mat material M from the second conveying path 11B, and also imparts a force which urges the discharge end in the reversal direction to accelerate said discharge end on reversal. In this manner, the collection of cotton takes place evenly across the folded areas of the piled-up material M, thereby increasing the effective width and reducing the amount of edge trimming from the folded areas.

16 Claims, 16 Drawing Sheets

METHOD OF AND APPARATUS FOR MANUFACTURING PILED-UP COTTON MAT

BACKGROUND OF THE INVENTION

1. Field of the Invention

The invention relates to a method of and an apparatus for manufacturing piled-up cotton mat in which the collection or forming of cotton takes place by oscillating the downstream discharge end of an inorganic fiber mat which is continuously conveyed from an upstream point.

2. Description of the Prior Art

In the manufacture of a piled-up cotton mat comprising inorganic fibers such as rock wool or glass wool, a techinique, commonly referred to as a pendulum system as illustrated in FIGS. 18 and 19, has been employed (see OS-DE 41 27 172 A1 and WO 88/03121). As illustrated in FIG. 18, a pendulum system comprises a conveyor 2 which continuously conveys a mat material M1, commonly referred to as a primary web or collected primary fleece, which is then held between a pair of oscillating conveyors 3, 4 to be carried downward while the conveyors 3, 4 are subjected to an oscillating motion about the axis of a fulcrum roller 2A, defined by one of the rollers of the conveyor 2, under the control of an oscillating mechanism 5. As shown in FIG. 19, the mat material M1 which is discharged at a given rate from the oscillating ends 8 of the oscillating conveyors 3, 4 is dropped in a shaken manner onto a forming conveyor 6 located below it for accumulation thereon to manufacture a piled-up cotton mat 7 while the conveyors 3, 4 experience a traverse motion. Upon inversion of the direction D1 of traverse motion or when the mat material M1 is being folded upon itself, there occurs a glut of the mat 7 in folded areas 7A, 7B since during a time interval t10 which is required for the oscillating end 8 to reach a given speed of oscillating motion after it has passed through either dead point P10 or P20, the speed as projected onto a horizontal plane diminishes. Accordingly, an effective width Wef1 of the piled-up mat measured across the folded areas 7A, 7B must be determined in consideration of such glut of the mat 7 in the folded areas 7A, 7B, which must be edge trimmed to produce a final product.

In conventional mats, the magnitude of the glut occurring in the folded areas 7A, 7B depend on the material and the thickness of the mat material, whereby the surface density of the entire mat 7 as viewed in the direction of traverse motion tends to be uneven. This necessitated that a stroke of the oscillation motion be chosen to be predeteminately greater in consideration of variations in the folded areas in order to secure a desired effective width. This resulted in an increase in the amount of edge trim of the folded areas 7A, 7B to cause a cost increase upon finishing into a final product.

SUMMARY OF THE INVENTION

Accordingly, it is an object of the invention to provide a method of and an apparatus for manufacturing a piled-up cotton mat in which during the formation of the mat, a rising speed from the inversion of the discharge end of the mat material until it restores an oscillating speed is increased to thereby provide a smooth and rapid reversal of the traverse motion and in which upon reversal of the traverse motion, a tension is applied to the mat material in a given direction of reversal so as to provide an even edge of the mat being piled up as viewed in the direction of traverse motion and to allow the forming of cotton mat with an even surface density over the entire mat, thereby allowing the amount of edge trim of folded areas to be reduced.

Above object of the invention is accomplished in a method of manufacturing a piled-up cotton mat including the steps of delivering a mat material which is continuously supplied through a first conveying path to a second conveying path, holding the mat material in sandwiched form in the second conveying path while the mat is being conveyed thereby, oscillating the second conveying path about a fulcrum defined by a downstream point on the first conveying path to discharge the mat material from the oscillating end of the second conveying path in a traverse motion, thus accumulating the mat material on a running cotton collecting or forming conveyor. In accordance with the invention, the conveying speed of the mat material is maintained at a given value while the oscillating end is oscillated with a given oscillating speed so that during the reversal of the oscillating end, the oscillating end is accelerated to increase the rising speed during a time interval from the dead point of the traverse motion until it reaches the oscillating speed, and pulling a folded area in the direction of reversal when the mat material is being folded upon itself upon reversal of the oscillating end, thereby providing an even edge width of the mat material as viewed in the direction of traverse motion and an even surface density thereof.

The described object of the invention is also accomplished in an apparatus for manufacturing a piled-up cotton mat including first conveying means which conveys a mat material which is continuously supplied along a first conveying path, second conveying means for conveying the mat material delivered from the first conveying means while holding it sandwiched within a second conveying path, and oscillating means for oscillating the second conveying path about a fulcrum defined by a downstream point on the first conveying path, thereby discharging the mat material from an oscillating end of the second conveying path in a traverse motion to be accumulated on a running cotton collecting or forming conveyor. In accordance with the invention, there is provided acceleration means for accelerating the oscillating end to increase the rising speed from the dead point until it reaches the oscillating speed during the reversal of the traverse motion, thereby oscillating the oscillating end with a given oscillating speed to accelerate the oscillating end upon reversal of the traverse motion of the mat material while maintaining the conveying speed of the mat material constant.

In the method of manufacturing a piled-up cotton mat according to the invention, the conveying speed of the mat material is maintained at a given value, and mat material is discharged downward from the oscillating end to be foled upon itself and accumulated thereon, but upon reversal of the oscillating end, the rising speed of the oscillating end is accelerated so as to restore a given oscillating speed rapidly. Accordingly, when the mat material is being folded upon itself, the mat material will be pulled in the direction of reversal in accordance with such acceleration, thereby providing an even edge width as viewed in the direction of traverse motion and an even surface density over the entire mat.

In the apparatus for manufacturing a piled-up cotton mat according to the invention, a mat material which is continuously supplied is conveyed at a given conveying speed while it is held sandwiched within a second conveying path, and mat material is discharged downward so as to be foled upon itself and accumulated while applying an oscillating motion from oscillating means. Upon reversal of the oscillating end, the oscillating end is accelerated by acceleration means to increase the rising speed so that a given oscillating speed is rapidly restored, whereby upon folding the mat material upon itself, the mat material will be pulled in the direction of reversal in accordance with such acceleration to produce an even edge width as viewed in the direction of traverse motion and an even surface density over the entire web.

Above and other objects and advantages of the invention will become apparent from the following description with reference to the attached drawings.

DETAILED DESCRIPTION OF PREFERRED EMBODIMENTS

Figure 1:
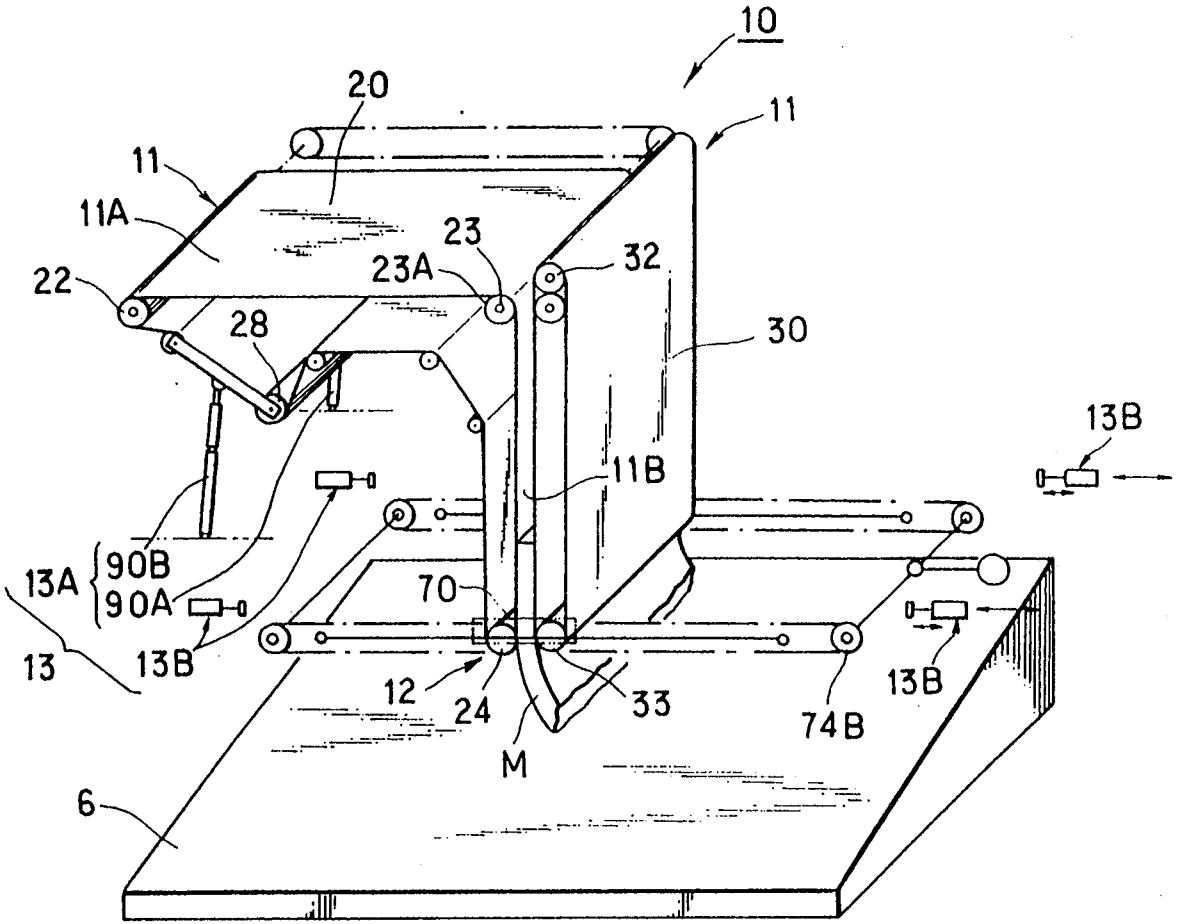
FIG. 1 is a schematic illustration of an apparatus for manufacturing a piled-up cotton mat according to one embodiment of the invention.

Referring to the drawings, several embodiments of the invention will now be described. As shown in FIG. 1, an apparatus 10 for manufacturing a piled-up cotton mat comprises a conveying mechanism 11, an oscillating mechanism 12 and an acceleration mechanism 13.

Figure 2:
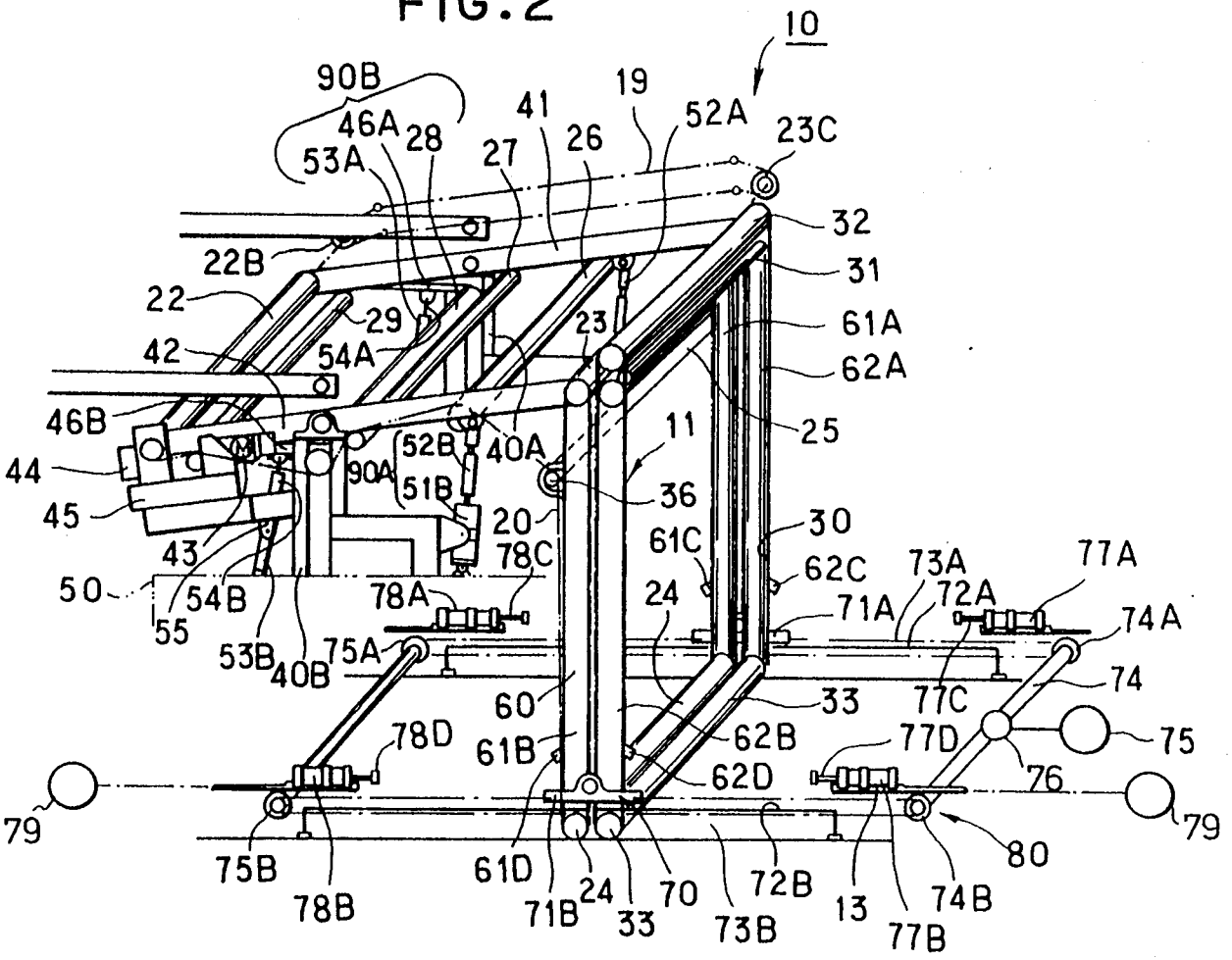
FIG. 2 is a perspective view of the apparatus shown in FIG. 1, partly omitted.
Figure 6:
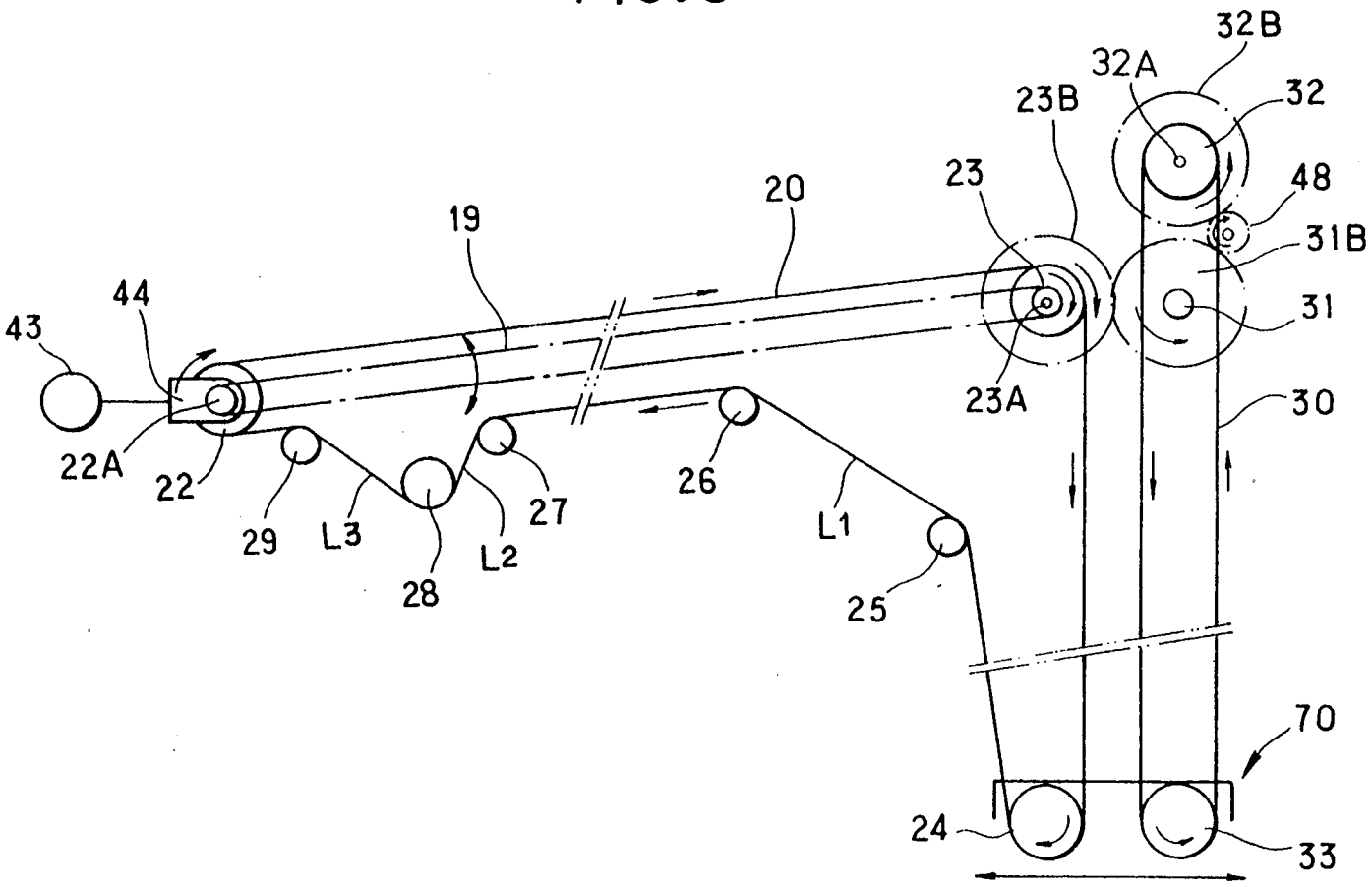
FIG. 6 is a schematic illustration of directions of rotations and conveying directions occurring in the drive system shown in FIG. 5.

Referring to FIGS. 2 and 6, the conveying mechanism 11 comprises a first bank of rollers 22–29, a second bank of rollers 32, 33, a first conveyor belt 20 extending around the bank of rollers 22–29, a second conveyor belt 30 extending around the bank of rollers 32, 33, and a drive unit 43, 44 which drive the first and the second conveyor belt 20, 30 in opposite directions from each other. These belts exhibit a resilience.

Figure 3:
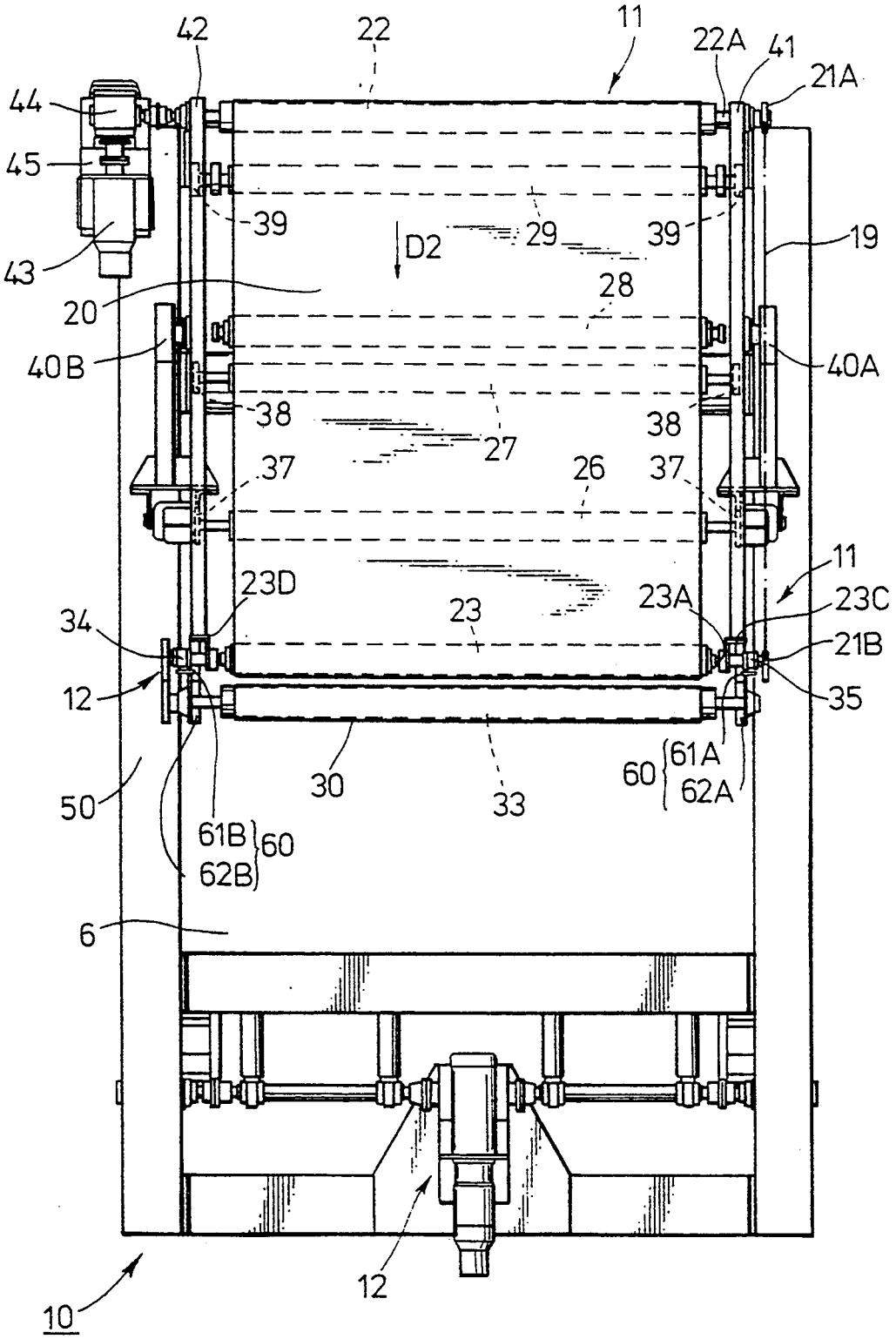
FIG. 3 is a plan view of the apparatus shown in FIG. 1.
Figure 5:
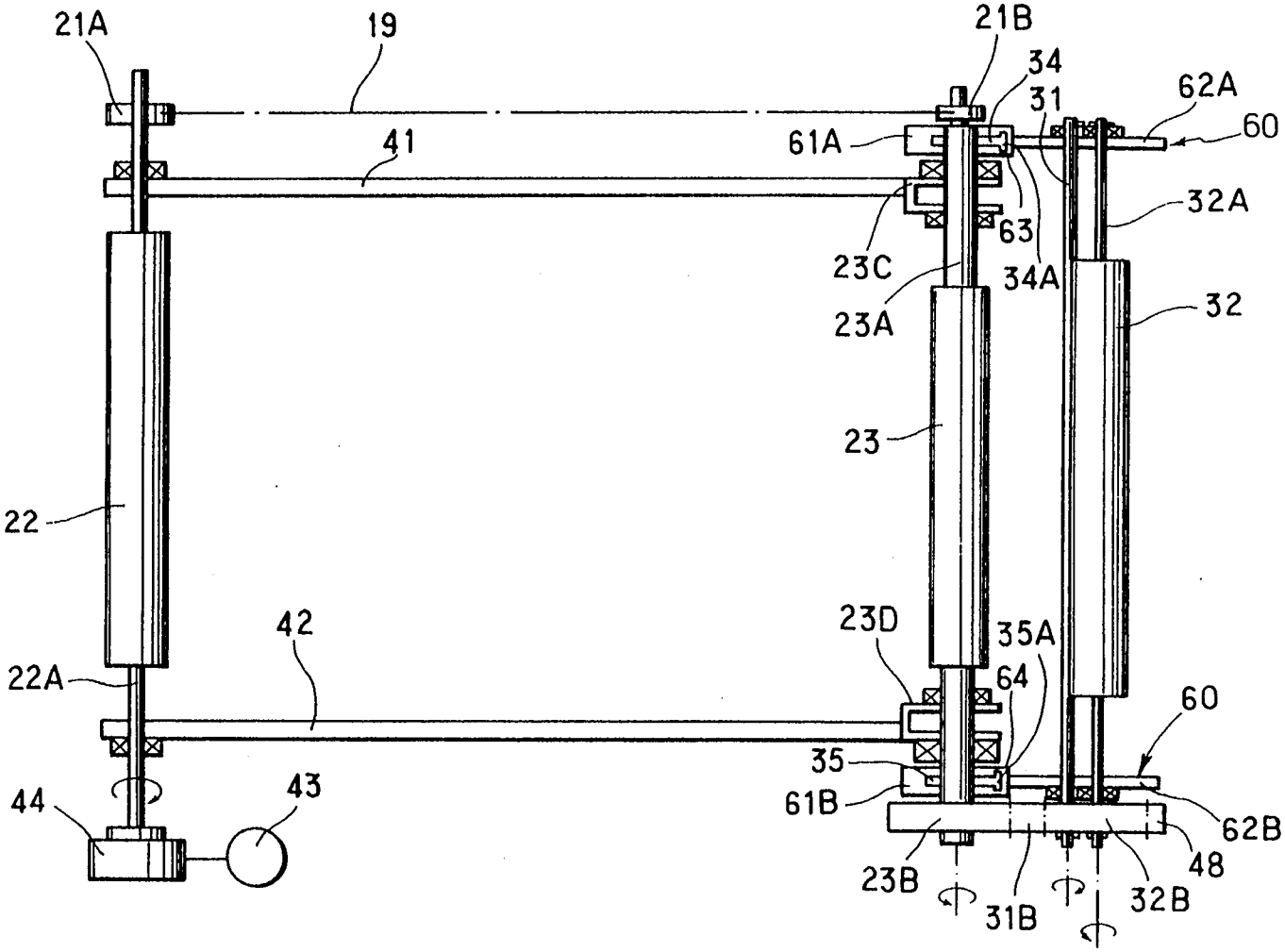
FIG. 5 is a schematic illustration of a drive system for the apparatus shown in FIG. 1.
Figure 7:
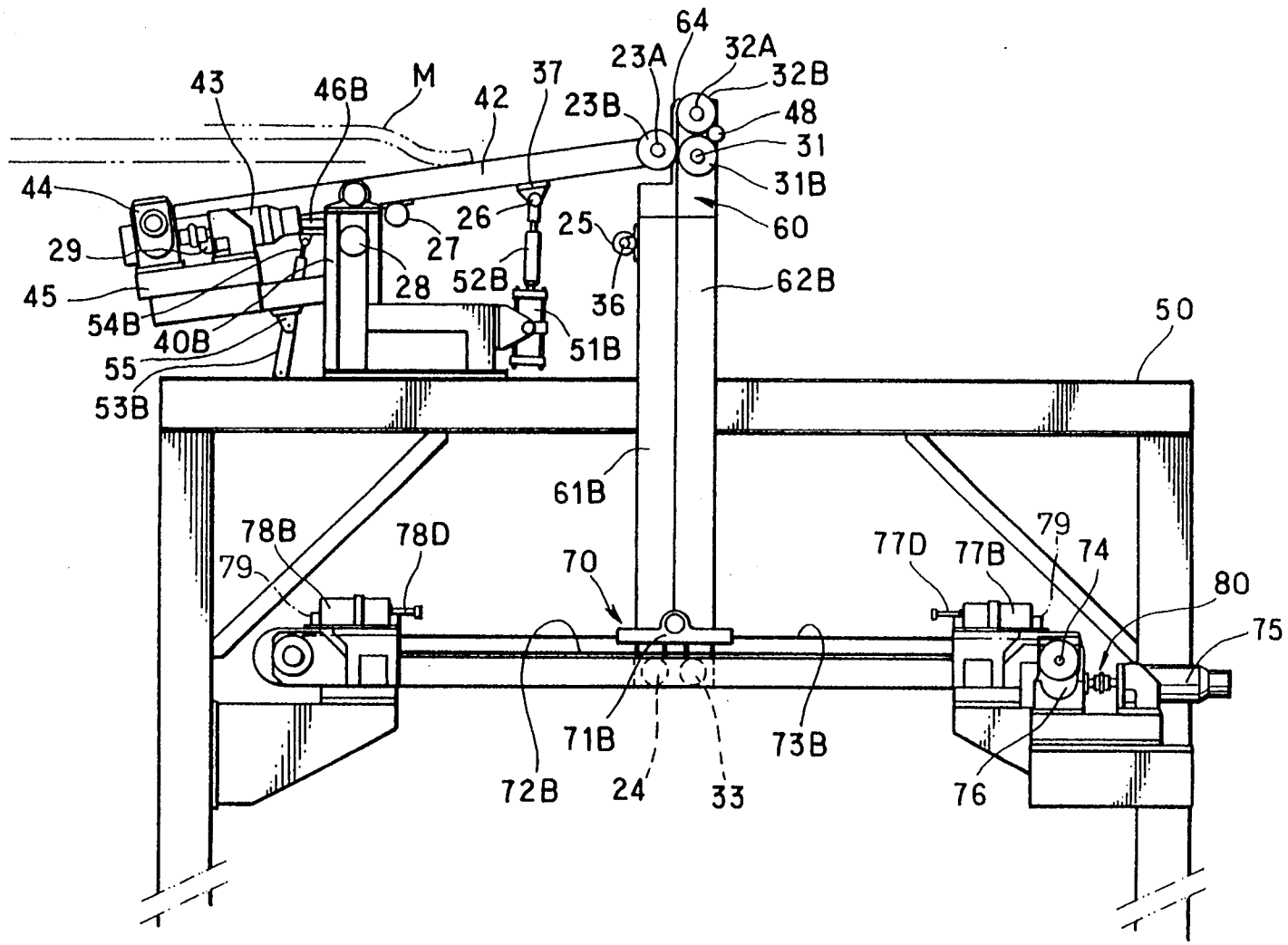
FIG. 7 is a left-hand side elevation of FIG. 1.
Figure 8:
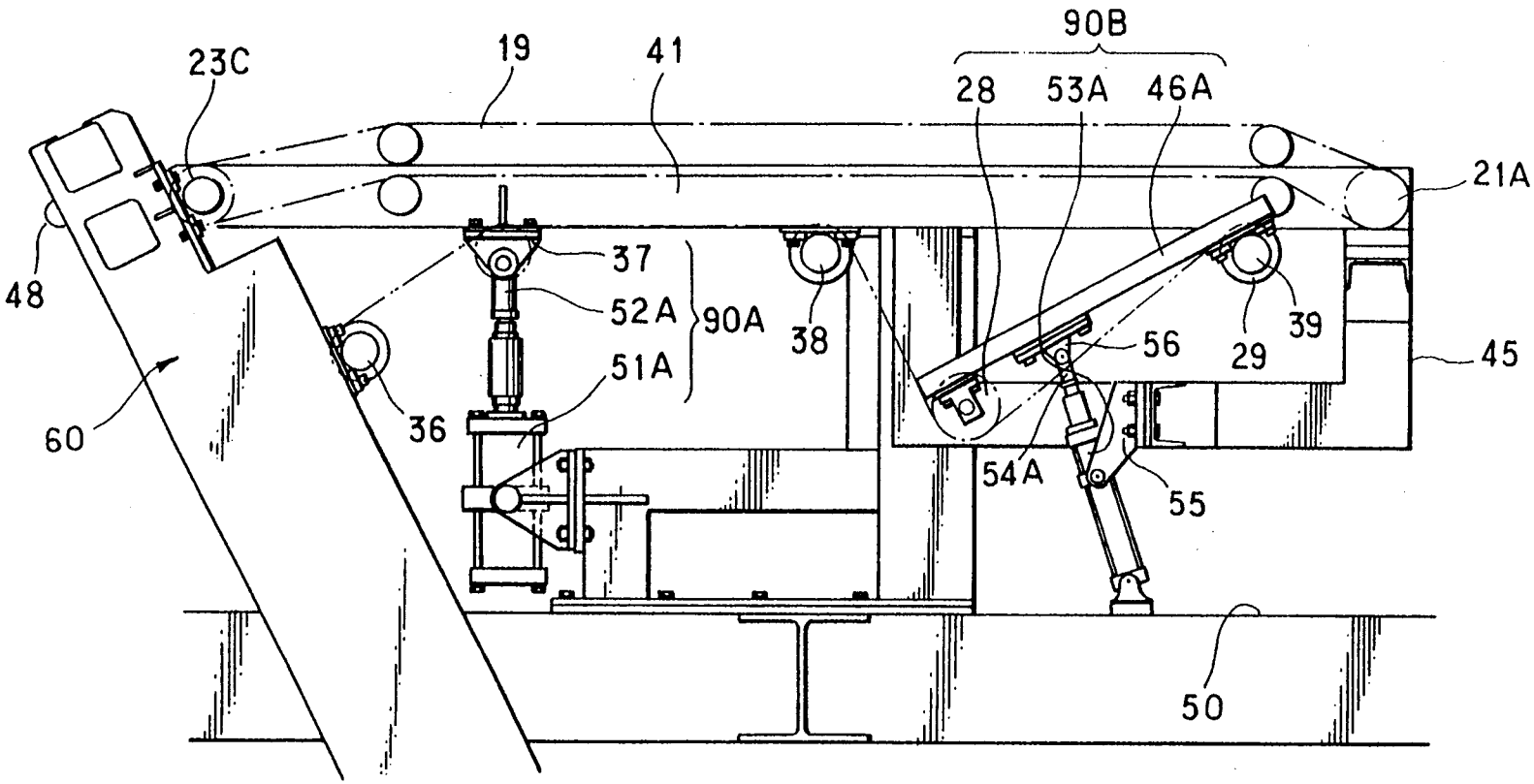
FIG. 8 is a right-hand side elevation of essential part of FIG. 1.
Figure 9:
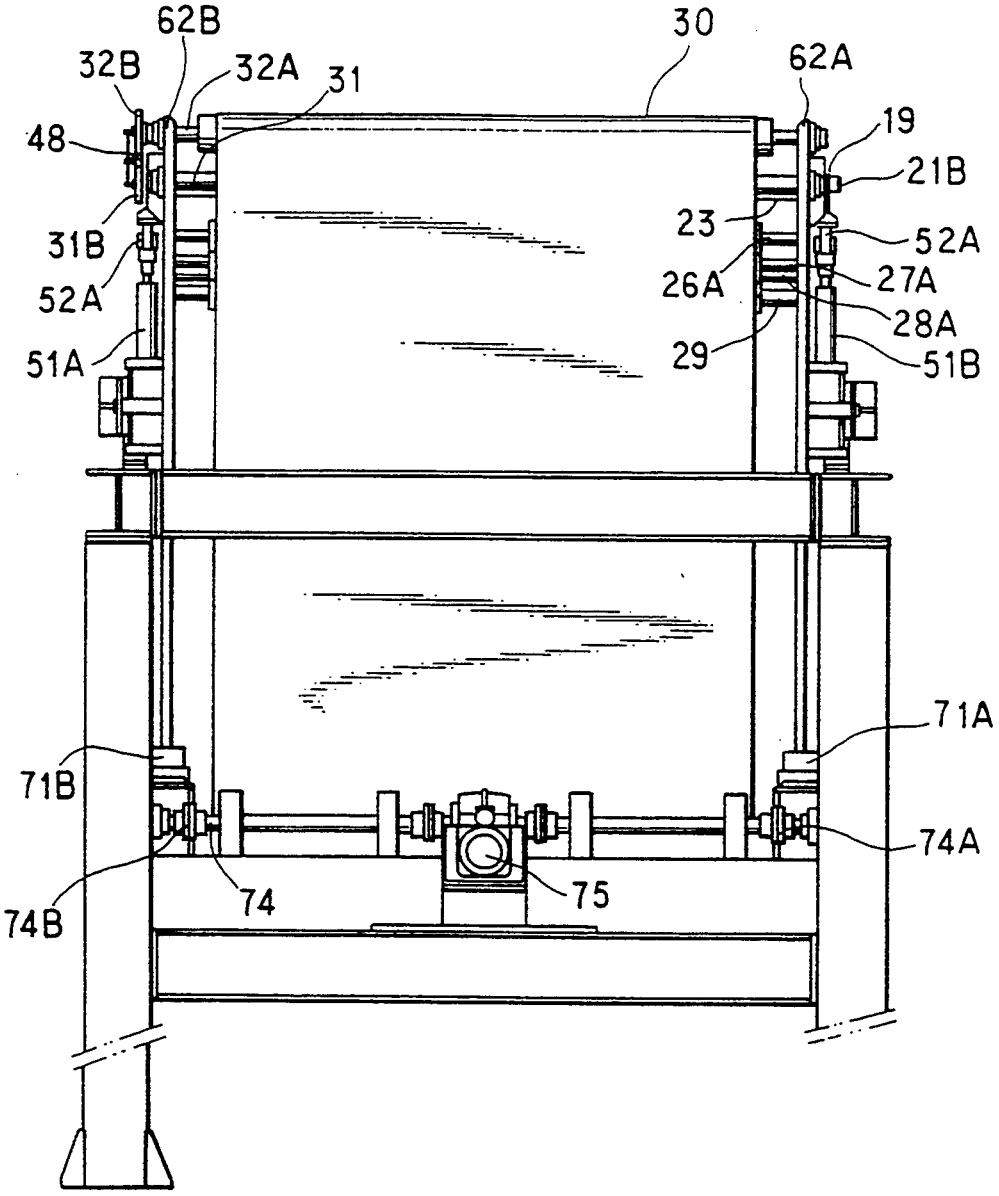
FIG. 9 is a front view of the apparatus shown in FIG. 1.

As shown in FIGS. 3 and 5, a first drive roller 22 of the first bank has its opposite ends rotatably journalled by upstream ends of support frames 41, 42, and includes a shaft 22A, one end of which is connected to a drive motor 43 through a transmission 44. As shown in FIGS. 2 and 3, the support frames 41, 42 extend along the opposite lateral sides of a flow or movement of a mat material, and have portions corresponding to their centers of gravity rockably mounted on a pair of standards 40A, 40B which are fixedly mounted on a pedestal 50 so as to be capable of seesaw motion. A mount 45 is mounted on the upstream portions of the support frames 41, 42 for carrying the drive motor 43 and the transmission 44 thereon. As illustrated in FIGS. 7 and 8, a pair of first air cylinders 51A, 51B, functioning as elevators which operate in synchronism with each other, are tiltably mounted on the pedestal 50, and are connected to brackets 37 of the support frames 41, 42, respectively, through reciprocating rods 52A, 52B, respectively. The first air cylinders 51A, 51B support the support frames 41, 42 so as to be rockable about the fulcrum, defined by their connection with the standards 40A, 40B as the rods 52A, 52B reciprocate.

Figure 4:
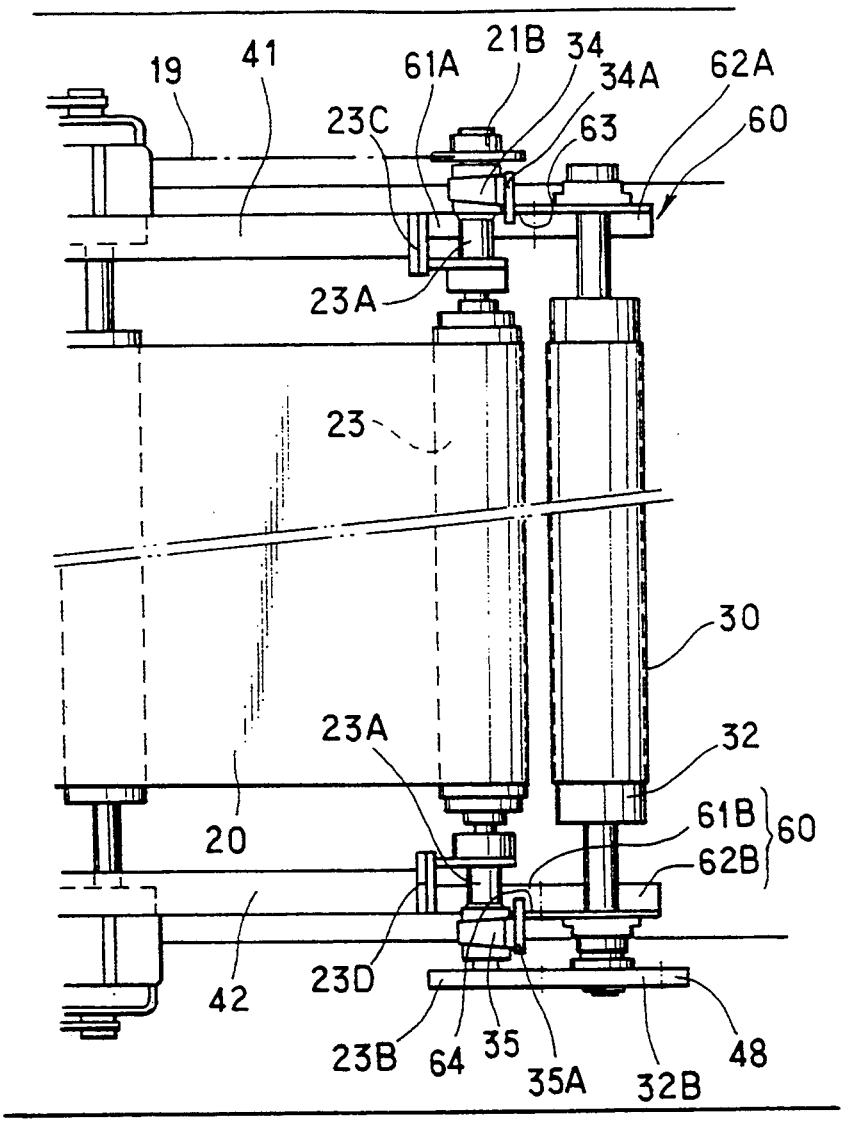
FIG. 4 is a fragmentary enlarged plan view of an essential part shown in FIG. 3.

As shown in FIG. 5, the other end of the shaft 22A of the first drive roller 22 extends through the support frame 41 and fixedly carries a sprocket wheel 21A thereon, around which a chain 19 extends. As shown in FIGS. 3 and 4, a first conveying roller 23, functioning as a guide pulley, is rotatably mounted across brackets 23C, 23D which are mounted on the downstream ends of the support frames 41, 42. Referring to FIG. 5, the first conveying roller 23 includes a shaft 23A, one end of which extends through the bracket 23C of the support from 41 and also through a sliding bracket 34 associated with an oscillating frame 60. At this end, the shaft 23A has a sprocket wheel 21B fixedly mounted thereon. The chain 19 also extends around the sprocket wheel 21B, whereby the first drive roller 22 and the first conveying roller 23 are connected together. Referring to FIGS. 5 and 6, it will be seen that the first drive roller 22 is effective, when a drive from the drive motor 43 is transmitted thereto, to transmit such drive to the first conveying roller 23 through the chain 19. Also referring to FIGS. 4 and 5, it will be seen that the other end of the shaft 23A extends through the bracket 23D on the support frame 42 and also through a sliding bracket 35 associated with the sliding frame 60, having a drive gear 23B fixedly mounted thereon.

Referring to FIGS. 2 and 7, the oscillating frame 60 is disposed downstream of the support frames 41, 42, and comprises pairs of first and second oscillating plate members 61A, 61B and 62A, 62B, which are disposed on the opposite lateral sides of the flow or movement of the mat material, each pair of oscillating plate members being juxtaposed to each other. Referring to FIGS. 4 and 5, it will be noted that the top of each of the first oscillating plate members 61A, 61B is formed with a groove 63 or 64, in which one end 34A or 35A of the sliding bracket 34 or 35 is fitted for sliding movement vertically therein. The arrangement of the oscillating frame 60 is such that the shaft 23A of the first conveying roller 23 rotatably extends through the sliding bracket 34, 35, whereby these members are capable of oscillating about the shaft 23A acting as a fulcrum. Referring to FIGS. 2 and 7, a second conveying roller 24 is rotatably mounted on the bottom ends of the first oscillating plate members 61A, 61B. A third conveying roller 25 is rotatably mounted on the upper portions of the first oscillating plate members 61A, 61B through brackets 36. As shown in FIG. 8, brackets are mounted on the underside of the support frames 41, 42 and are numbered as brackets 37, 38 and 39, respectively, as viewed from the downstream end of the support frames 41, 42. Referring to FIG. 3, it will be noted that a fourth, a fifth and a seventh conveying roller 26, 27 and 29 are rotatably mounted on these brackets 37, 38 and 39, respectively. A sixth conveying roller 28 which is vertically displaceable has its opposite ends rotatably mounted on support plates 46A, 46B which will be described later (see FIG. 2).

Referring to FIGS. 3 and 6, it will be seen that the resilient first conveyor belt 20 has its inner side disposed to abut against and to extend around the first drive roller 22, first conveying roller 23, second conveying roller 24, and sixth conveying roller 28 while its outer surface is disposed for abutment against the third, the fourth, the fifth and the seventh conveying roller 25, 26, 27 and 29. In this manner, the first conveyor belt 20 is disposed so that when the first drive roller 22 is driven for clockwise rotation as indicated by an arrow in FIG. 6, the associated rollers 22–29 also rotate in following relationship therewith. The first conveyor belt 20 is constructed such that the oscillating moton of the oscillating frame 60 causes a path L1 between the third and the fourth conveying roller 25, 26 to change while a vertical displacement of the sixth conveying roller 28 also causes a change in a path L2 between the fifth and the sixth conveying roller 27, 28 and also a change in a path L3 located between the sixth and the seventh conveying roller 28, 29. The conveying mechanism 11 includes a first conveying path 11A which comprises a run of the first conveyor belt 20 which is disposed between the first drive roller 22 and the first conveying roller 23.

Referring to FIGS. 2 and 7, it will be noted that the second oscillating plate members 62A, 62B are disposed in juxtaposition with the first oscillating plate members 61A, 61B. A second drive roller 32 and a drive transmission shaft 31 which is vertically displaced downward from the roller 32 are rotatably mounted on the top portion of the second oscillating plate members 62A, 62B while an eighth conveying roller 33 is rotatably mounted across the bottom ends of these plate members. The resilient second conveyor belt 30 extends around the second drive roller 32 and the eighth conveying roller 33. The conveying mechanism 11 includes a second conveying path 11B, which comprises runs of the first and the second conveyor belt 20, 30 which are disposed opposite to each other and which are driven to run in the same direction, as indicated in FIG. 6.

The drive transmission shaft 31 and the shaft 32A of the second drive roller 32 extend through the second oscillating plate member 62B, and fixedly carry planet gears 31B, 32B on their ends, between which an intermediate gear 48 is disposed for meshing engagement with the respective planet gears 31B, 32B. The planet gear 31B on the drive transmission shaft 31 also meshes with the drive gear 23B, as shown in FIGS. 6 and 7. When the first conveying roller 23 rotates clockwise as shown in FIG. 6, the drive gear 23B rotates clockwise as viewed in FIG. 6. The clockwise rotating drive from the first conveying roller 23 is transmitted from the drive gear 23B to the planet gear 31B, and thence transmitted through the intermediate gear 48 to the planet gear 32B. When the drive gear 23B rotates clockwise, the planet gear 31B transmits the rotating drive to the planet gear 32B while rotating itself about the drive gear 23B in accordance with the oscillating motion of the oscillating frame 60. Accordingly, the planet gear 31B turns around the drive gear 23B in accordance with a phase difference between the shaft 23A and the oscillating frame 60 to produce a smooth reciprocating motion of the lower end of the oscillating frame 60 as the oscillating frame 60 oscillates about the axis of the shaft 23A to thereby cause the top of the oscillating frame to become skewed or to be displaced vertically.

Accordingly, when the first conveying roller 23 is driven for clockwise rotation from the drive unit 43 through the chain 19, in the manner shown in FIG. 6, the drive from the first conveying roller 23 is transmitted to the gears 23B, 31B, 48 and 32B, sequentially, causing the drive transmission shaft 31 to rotate counter-clockwise and rotating the intermediate gear 48 clockwise, as viewed in FIG. 6, whereby the second drive roller 32 and the eighth conveying roller 33 are driven for counter-clockwise rotation as viewed in FIG. 6. In this manner, when the first drive roller 22 is driven for rotation by the drive unit 43, the second conveyor belt 30 is driven to run in the direction of the flow or a direction indicated by an arrow in FIG. 6 in synchronism with the first conveyor belt 20.

Figure 10:
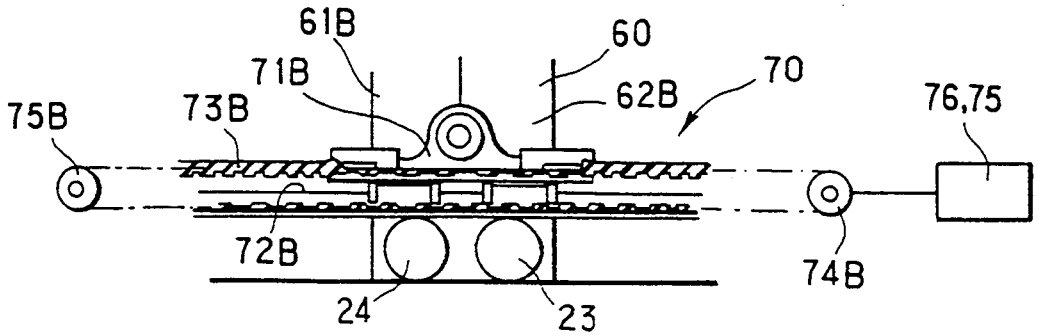
FIG. 10 is a side elevation of an essential part of a reciprocating mechanism.

The oscillating mechanism 12 comprises the oscillating frame 60 and a reciprocating mechanism 70 as illustrated in FIGS. 2 and 7. Referring to FIG. 10, the reciprocating mechanism 70 causes a reciprocating motion of guide members 71A, 71B mounted on the bottom of the oscillating frame 60, causing the lower end of the oscillating frame 60 to reciprocate horizontally about a fulcrum defined by the shaft 23A. Referring to FIG. 2, the reciprocating mechanism 70 comprises a motor 75, a transmission 76, sprocket wheels 74A, 75A, 74B, 75B and drive chains 73A, 73B. The guide members 71A, 71B provide for pivotablly mounting of oscillating plate members 61A, 62A which are disposed on one side and also of the oscillating plate members 61B, 62B which are disposed on the other side, and are slidably disposed on linear guides 72A, 72B, respectively. The guide members 71A, 71B are connected with drive chains 73A, 73B which extend around the sprocket wheels 74A, 75A, 74B and 75B, respectively. A drive shaft 74 is connected between the both sprocket wheels 74A, 74B which are disposed on the drive side, and is connected to the motor 75 through the transmission 76. The reciprocating mechanism 70 transmits a rotating drive from the motor 75 to the drive shaft 74 through the transmission 76, thereby causing the drive side sprocket wheels 74A, 74B to rotate in a forward and a reverse direction at a given cycle to thereby cause a horizontal reciprocating motion of the guide members 71A, 71B. Referring to FIGS. 2 and 7, it will be noted that third air cylinders 77A, 77B, 78A, 78B, acting as accelerators, are disposed at given locations in the direction of oscillating motion of the oscillating frame 60. The third air cylinders 77A, 77B, 78A and 78B operate to cause individual reciprocating rods 77C, 77D, 78C, 78D to abut against abutments 61C, 61D, 62C, 62D on the oscillating frame 60 to limit the stroke of the reciprocating motion to a given value upon reversal of the oscillating frame 60, and also perform a buffering action by reducing impacts. The third air cylinders 77A, 77B, 78A, 78B cause the reciprocating rods 77C, 77D, 78C, 78D to project in accordance with an air pressure introduced into the air cylinders to drive them against the abutments 61C, 61D, 62C, 62D on the oscillating frame 60, thus accelerating the oscillating frame 60 in the direction of reversal during the reversal of the oscillating frame 60.

It is to be noted that the acceleration mechanism 13 comprises at least one of a first accelerating mechanism 13A which is formed by a tension adjuster 90 or a second accelerating mechanism 13B which comprises the third air cylinders 77A, 77B, 78A, 78B. Referring to FIGS. 2 and 8, the tension adjuster 90 comprises an elevator 90A and an urging unit 90B. The elevator 90A comprises first air cylinders 51A, 51B which are tiltably connected bwtween the pedestal 50 and the underside of the downstream portion of the support frames 61, 62, respectively. The urging unit 90B comprises second air cylinders 53A, 53B which are tiltably connected between support plates 46A, 46B and the pedestal 50, respectively. The support plates 46A, 46B are mounted so as to be rockable about the axis of the seventh conveying roller 29 carried by the upstream portion of the support frames 41, 42, respectively. The sixth conveying roller 28 is journalled across the rocking ends of the support plates 46A, 46B. The tension adjuster 90 allows a tension in the first conveyor belt 20 to be adjustably controlled by causing the sixth conveying roller 28 to be displaced vertically and causing a rocking motion of the support frames 41, 42. At this end, the first conveyor belt 20 is constructed to present a variable length of the paths L2, L3. The second air cylinders 53A, 53B are rockably mounted on the pedestal 50. The second air cylinders 53A, 53B have their bodies tiltably connected to the support mount 45 through brackets 55.

The second air cylinders 53A, 53B include reciprocating rods 54A, 54B, which are mounted on the underside of the rocking ends of the support plates 46A, 46B through brackets 56 and which are operated in synchronism with each other. As the rods 54A, 54B reciprocate, the second air cylinders 53A, 53B cause the support plates 46A, 46B to rock about the axis of the seventh conveying roller 29, thereby supporting the sixth conveying roller 28 so as to be vertically displaceable. When the rods 54A, 54B reciprocate forwardly to raise the sixth conveying roller 28 upward, the second air cylinders 53A, 53B reduce the magnitude of a tension F in the first conveyor belt 20. Conversely, when the rods 54A, 54B retract to push the sixth conveying roller 28 downward, the second air cylinders 53A, 53B produce a greater tension F1 (F1>F) in the first conveyor belt 20 which threads between the rollers 22, 23, 24 and 28.

Figure 12:
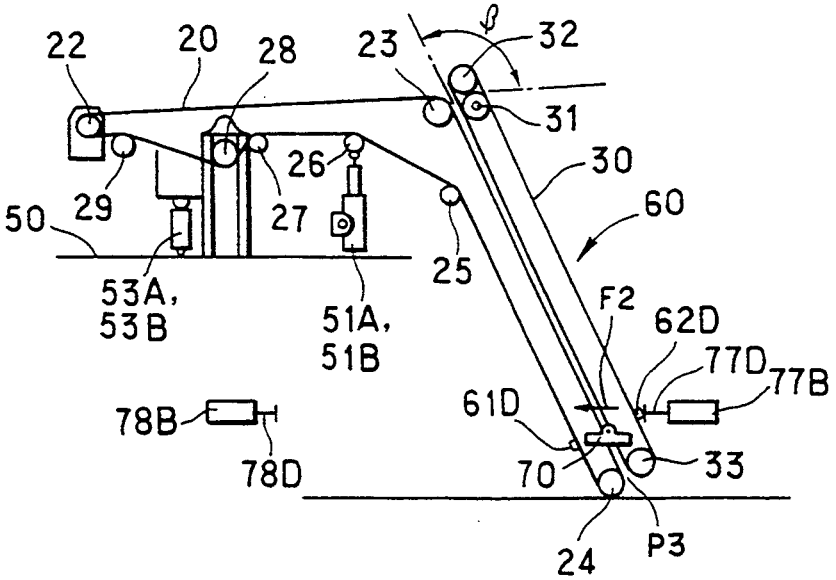
FIG. 12 is an illustration of another phase of operation of the conveyor belt.
Figure 13:
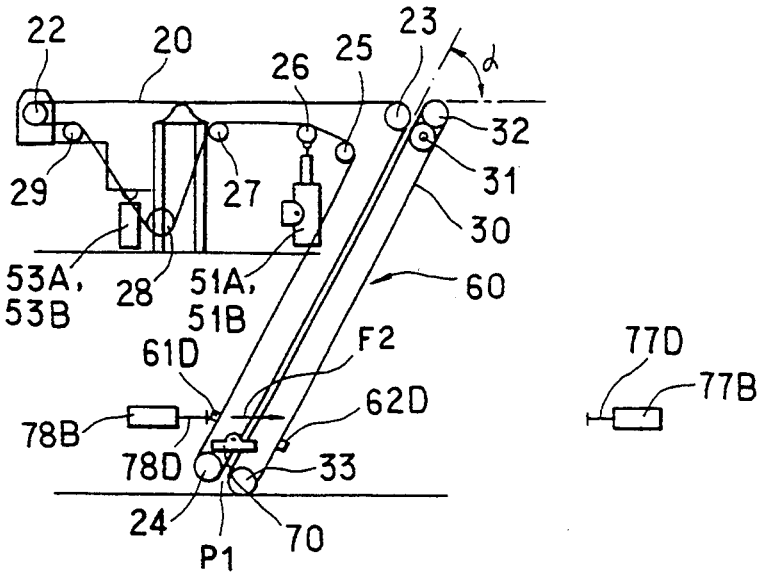
FIG. 13 is an illustration of a further phase of operation of the conveyor belt.

Referring to FIG. 13, when the oscillating frame 60 is at its point of reversal P1, namely, when an angle $\alpha$ formed between a run of the first conveyor belt 20 extending between the first drive roller 22 and the first conveying roller 23 and another run of the first conveyor belt 20 extending between the first conveying roller 23 and the second conveying roller 24 is at its minimum, the sixth conveying roller 28 is depressed lowermost to impart a tension F1 of a given magnitude to the first conveyor belt 20 for urging it for returning motion upon reversal, thereby reducing a rising time until it restores a reciprocating speed of a give value. As the oscillating frame 60 again begins its oscillating motion from the point of reversal P1, the sixth conveying roller 28 is gradually raised upward (see point P2 shown in FIG. 11), and is raised to its uppermost position at another point of reversal P3 where an angle $\beta$ formed between a run of the first conveyor belt 20 extending between the first drive roller 22 and the first conveying roller 23 and another run of the first conveyor belt 20 extending between the first conveying roller 23 and the second conveying roller 24 is at its maximum (see FIG. 12). When the oscillating frame 60 assumes either point of reversal P1 or P3, the first air cylinders 51A, 51B support the support frames 41, 42 in a slightly inclined position, and operate to elevate the downstream portion, or portion located adjacent to the first conveying roller, of the support frames 41, 42 while the oscillating frame 60 oscillates from either point of reversal P1 or P3 to substantially vertical position P2, thus assuring a given path length which prevents a slack from occurring in the first conveyor belt 20.

Referring to FIG. 2, the third air cylinders 77A, 77B and 78A, 78B, which form the second accelerating mechanism 13B, are disposed on the outside of extensions of the reciprocating path of the lower end of the oscillating frame 60 so as to permit a spacing between the third air cylinders 77A, 77B and the remaining third air cylinders 78A, 78B to be adjusted by an adjuster 79 in accordance with the reciprocating stroke of the oscillating frame 60. Each pair of third air cylinders 77A, 77B and 78A, 78B is operative to cause the respective reciprocating rods 77C, 77D and 78C, 78D to abut against the abutments 61C, 61D and 62C, 62D on the oscillating frame 60 immediately before the reversal of the oscillating frame 60 to thereby absorb the impacts, and then immediately upon absorption of such impacts, to cause these rods to project forward in synchronism with each other to impart a force F2 in the reciprocating direction to the oscillating frame 60, thereby reducing the rising time which is required for the oscillating frame 60 to restore a reciprocating speed of a given magnitude.

A method of manufacturing a piled-up cotton mat will be described in connection with the operation of the described apparatus. The apparatus 10 is set in motion when the conveying mechanism 11 is driven by the drive motor 43 and the oscillating mechanism 12 is driven by the reciprocating mechanism 70. The acceleration mechanism 13 is energized when either one of the first accelerating mechanism 13A or the second accelerating mechanism 13B is operated. Initially, the operation of the apparatus 10 will be described when the conveying mechanism 11, the oscillating mechanism 12 and the first accelerating mechanism 13A are operated.

When the rotary drive from the drive motor 43 is transmitted to the first drive roller 22 through the transmission 44, the first drive roller 22 rotates in the direction of the flow or clockwise as viewed in FIG. 6. When the first drive roller 22 is driven for rotation, the first conveyor belt 20 transmits such drive from the first drive roller 22 to the first conveying roller 23, the second conveying roller 24 and the sixth conveying roller 28 sequentially. On the other hand, when the drive from the drive motor 43 is transmitted to the first drive roller 22, such drive is also transmitted to the first conveying roller 23 also through the chain 19 which extends around the sprocket wheels 21A, 21B, and the rotating drive from the first drive roller 23 is transmitted through the drive gear 23B, planet gear 31B, intermediate gear 48 and planet gear 32B to the second drive roller 32, which is then driven for rotation in the opposite direction from the first drive roller 22, or counterclockwise as viewed in FIG. 6. Accordingly, the second conveyor belt 30 is driven in the opposite direction from the first conveyor belt 20.

When the mat material M is introduced onto the first conveying path 11A (see FIG. 1) of the first conveyor belt 20 from the outside, the mat material M will be conveyed in the flow direction of the first conveyor belt 20, and is conveyed downward at a given rate while it is held between the second conveyor belt 30 and the first conveyor belt 20 along the second conveying path 11B defined therebetween. When the motor 75 is switched between rotations in the forward and the reverse direction at a given time interval which depends on the stroke of a desired oscillating motion, the sprocket wheels 74A, 74B of the reciprocating mechanism 70, which are disposed on the drive side, are driven for rotation in the forward and the reverse direction through the transmission 76, and the drive chains 73A, 73B reciprocate in synchronism with each other, whereby the guide members 71A, 71B slide along the linear guides, causing the lower end of the oscillating frame 60 to reciprocate in the horizontal direction. Accordingly, the mat material M which is conveyed while being held sandwiched between the first and the second conveyor belt 20, 30 will be conveyed while its flow direction is rocked or oscillated about the fulcrum defined by the shaft 23A of the first conveying roller 23.

Figure 11:
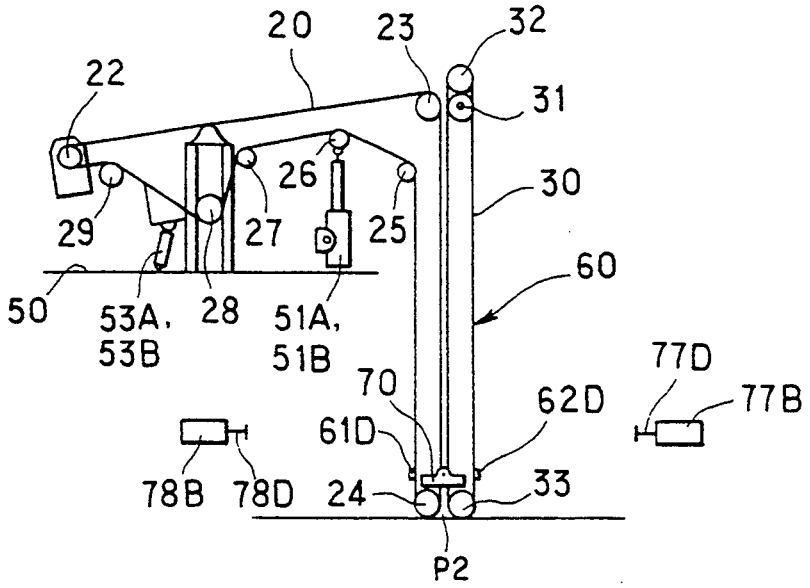
FIG. 11 is an illustration of the operation of a conveyor belt.

On the other hand, the lower end of the oscillating frame 60, or the discharge ends of the first and the second conveyor belt 20, 30 are maintained in horizontal reciprocating motion, so that the top of the oscillating frame 60 will experience a vertical displacement as illustrated in FIGS. 11 to 13 and the sliding brackets 34, 35 slide within the grooves 63, 64 formed in the first oscillating plate members 61A, 61B to be displaced in accordance with the phase difference between the oscillating frame 60 and the support frames 41, 42. At the same time, the planet gear 31B transmits the drive from the drive gear 23B to the planet gear 32B while rotating itself about the drive gear 23B in accordance with the inclination of the oscillating frame 60 to accommodate for the phase difference between the oscillating frame 60 and the support frames 41, 42, thus allowing the lower end of the oscillating frame 60 to reciprocate smoothly at a given rate until the reversal occurs. Hence, the mat material M which is conveyed between the first and the second conveyor belt 20, 30 while experiencing a rocking motion will be discharged at a given discharge rate and is discharged also at a given rate in the reciprocating direction of the lower end of the oscillating frame 60 as it is discharged from between these conveyor belts to be accumulated upon the forming conveyor 6.

During the oscillating motion of the oscillating frame 60, the tension adjuster 90 is operated in accordance with the stroke of a desired oscillating motion. As the oscillating frame 60 approaches the reversal position P1, the tension adjuster 90 operates the second air cylinders 53A, 53B to retract the rods 54A, 54B to thereby depress the support plates 46A, 46B downward about the axis 29A of the seventh conveying roller 29 while displacing the sixth conveying roller 28 to its lowermost position, thus imparting the tension F1 of a given magnitude to the first conveyor belt 20. Immediately before the lower end of the oscillating frame 60 reaches the reversal position P1 at a given reciprocating rate, the abutment of the abutments 61C, 61D on the oscillating frame 60 upon the rods 78C, 78D of the third air cylinders 78A, 78B causes the latter to instantaneously retard the reciprocating rate of the oscillating frame 60 through the rods 78C, 78D.

Figure 14:
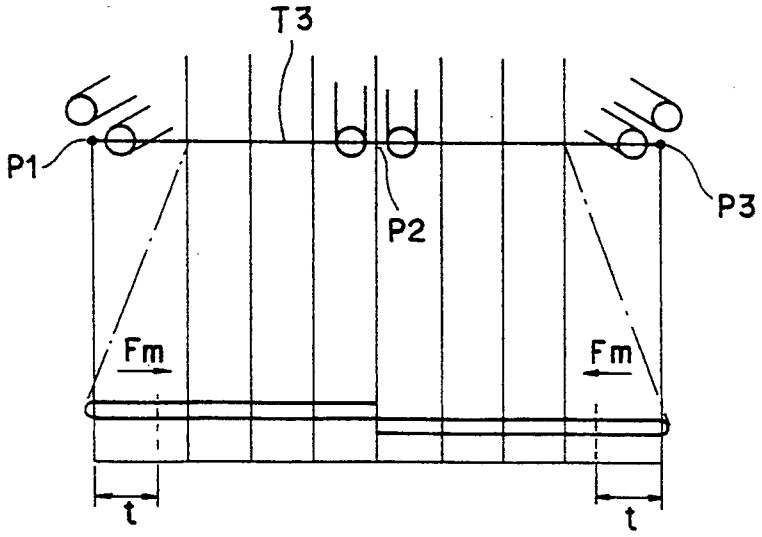
FIG. 14 is an illustration of a mat material as it is folded upon itself.

When the oscillating frame 60 reaches the reversal position P1 (dead center), the combined path length (L1+L2+L3) of the run of the first conveyor belt 20 extending from the third conveying roller 25 to the seventh conveying roller 27 will be at its maximum, whereby a maximum tension Fmax is produced in the first conveyor belt 20. At this time, the support frames 41, 42 will be supported substantially in horizontal position by means of the first air cylinders 51A, 51B (see FIG. 13). On the other hand, the reciprocating mechanism 70 requires a certain length of time lag t (see FIG. 14), which may be considered a rising time required to restore the reciprocating rate, which is caused by the mechanical mechanism for the drive in the reverse direction to be transmitted from the motor 75 to the guide members 71A, 71B. It restores the reciprocating rate after the given length of time t. At this time, a force, as represented by a horizontal vector directed in the reversal direction or directed from the left to the right (as viewed in FIG. 13), will be produced in the second conveying roller 24 around which the first conveyor belt 20 extends, in accordance with the magnitude of the tension Fmax in the first conveyor belt 20. This force as represented by the horizontal vector urges the oscillating frame 60 in the reversal direction with a force greater than the rising speed of the reciprocating mechanism 70, whereby the rising speed of the reciprocating mechanism 70 is accelerated to enable the latter to restore the reciprocating rate rapidly. As a consequence, the mat material M which is discharged from the discharge end of the first and the second conveyor belt 20, 30 will be discharged at a given discharge rate during the reversal of the oscillating frame 60, and because the frame 60 will be pulled in the reversal direction with a force of a given magnitude Fm and rapidly restores to its reciprocating rate, the folded areas of the mat material will be folded upon itself evenly in good agreement with the width of the stroke of the oscillating from 60 while simultaneously achieving an even surface density over the entire mat for purpose of cotton forming.

As the lower end of the oscillating frame 60 slides from the reversal position P1 toward the position P2 shown in FIG. 11, the sixth conveying roller 28 will be gradually raised upward so as to secure a given magnitude of tension in the first conveyor belt 20. As the lower end of the frame 60 moves from the position P1 toward the position P2, the support frames 41, 42 will have their downstream portions (located adjacent to the first conveying roller 23) raised upward by the first air cylinders 51A, 51B, which in turn raises the top of the oscillating frame 60, thus allowing a smooth reciprocating motion of the reciprocating mechanism 70. The combined path length (L1+L2+L3) from the third conveying roller 25 to the seventh conveying roller 29 is maintained at a given value, thus maintaining the tension in the first conveyor belt 20 constant. At this time, the mat material M will be discharged at a given discharge rate from the conveyor belts 20, 30 and is accumulated upon the forming conveyor 6 at a given reciprocating rate.

As the lower end of the oscillating frame 60 moves from the position P2 shown in FIG. 11 toward the position P3 shown in FIG. 12, the sixth conveying roller 28 is raised further upward, and the downstream portion (adjacent to the first conveying roller 23) of the support frames 41, 42 will be depressed by a given amount by the first air cylinders 51A, 51B, thus assuming a slightly inclined position. Immediately before the lower end of the frame 60 reaches the reversal position P3 at the given reciprocating rate, the abutments 62C, 62D on the frame 60 abut against the rods 77C, 77D of the third air cylinders 77A, 77B, thus instantaneously reducing the reciprocating rate of the oscillating frame 60.

When the oscillating frame 60 reaches the reversal position P3 (dead center), the combined length (L1+L2+L3) of the first conveyor belt 20 from the third conveying roller 25 to the seventh conveying roller 29 will be at its maximum, whereby the tension Fmax produced in the first conveyor belt 20 will also be at its maximum again. On the other hand, the reciprocating mechanism 70 restores its reciprocating rate after a given rising time t, in the similar manner as when the frame 60 reached the reversal position P1. At this time, a force as presented by a horizontal vector acting in the reversal direction (or from the right to the left, as viewed in FIG. 12) and which depends on the magnitude of the tension Fmax in the first conveyor belt 20 will be applied to the second conveying roller 24, and overcomes the rising speed of the reciprocating mechanism 70 to urge the oscillating frame 60 in the reversal direction, thereby accelerating the rising speed of the reciprocating mechanism 70 and thus allowing it to restore the reciprocating rate rapidly. As a consequence, the mat material M which is discharged from the discharge ends of the first and the second conveyor belts 20, 30 will be discharged at a given discharge rate during the reversal of the oscillating frame 60, in the similar manner as when the frame 60 reached the reversal position P1, and because it is pulled in the reversal direction with the force Fm of a given magnitude and then rapidly restores its reciprocating rate, the folded areas of the mat material will be evenly folded upon itself in good agreement with the width of the stroke of the oscillating frame 60 to provide an even accumulation. In this manner, the mat material M is discharged at a given rate from between the first and the second conveyor belt 20, 30, and since the described steps are repeated during the reversal of the discharge end of the mat material M, the mat material M will exhibit an even width across the opposite folded areas, thus achieving an even accumulation and an even surface density over the entire mat.

Figure 15A:
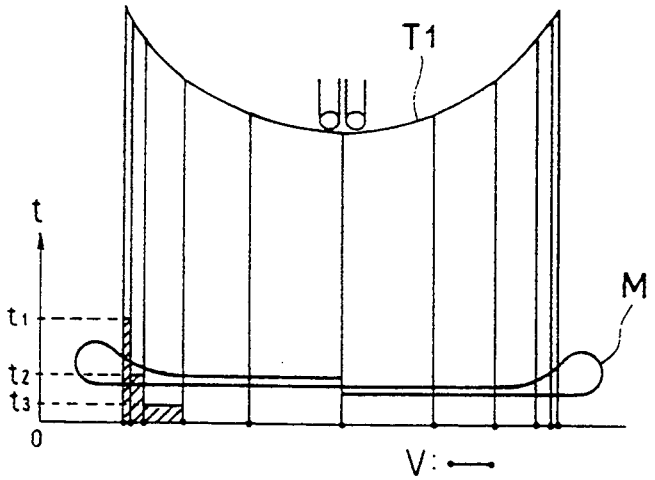
FIG. 15 (A) to (C) are graphical illustrations showing a trajectory of movement depicted by the discharged end of the mat material, a horizontal travel per given length of time of the discharge end of the mat material and the accumulation of the mat material corresponding to the trajectory of movement.
Figure 15B:
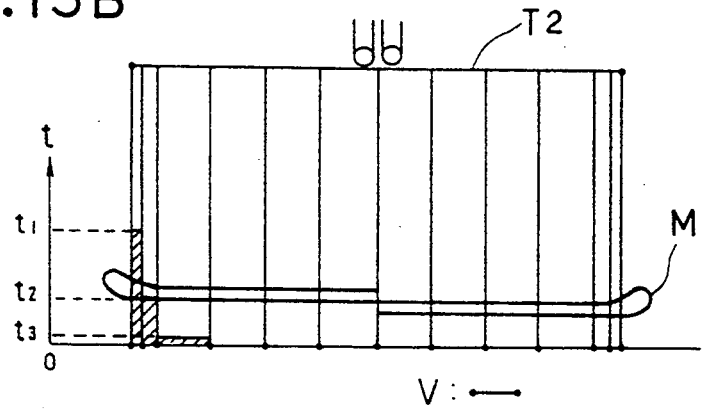
Figure 15C:
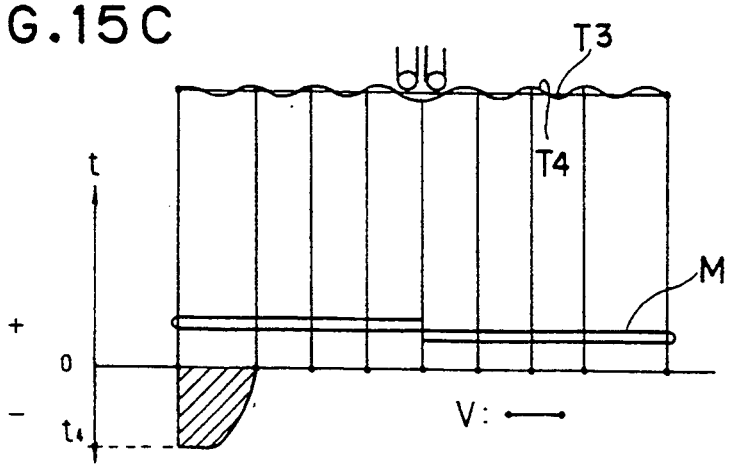

FIGS. 15 (A) to (C) illustrate trajectories T1–T4 of movement of the discharge end of the mat material M in comparison to the horizontal travel V per given length of time S of the discharge end of the mat material M as well as the accumulation of the mat material M corresponding to the trajectories of movement T1–T4. FIG. 15 (A) is an outcome of a conventional arrangement in which the discharge end of the mat material M is rocked to depict an arcuate trajectory and which is not provided with an accelerating mechanism. FIG. 15 (B) corresponds to an arrangement in which the discharge end of the mat material M undergoes a horizontal reciprocating motion, but which is not provided with an accelerating mechanism. FIG. 15 (C) illustrates an arrangement according to the invention in which The discharge end of the mat material M undergoes a horizontal or a substantially horizontal reciprocating motion and which is provided with an accelerating mechanism. Specifically, in FIGS. 15 (A) to (C), a rising time t (=t1+t2+t3) required for the discharge end of the mat material M to restore its reciprocating rate represents a rising time required when there is no acceleration during the reversal. By contrast, a rising time −t4 illustrates the outcome of the acceleration during the reversal. It will be apparent from FIGS. 15 (A) to (C) that the piled-up mat formed in accordance with the invention achieves an even surface density over the entire mat and a greater effective width across the opposite folded areas, thus reducing the amount of edge trimming.

The operation of the apparatus 10 when the conveying mechanism 11, the oscillating mechanism 12 and the second accelerating mechanism 13B are operated will be described below. The conveying mechanism 11 and the oscillating mechanism 12 operate in the same manner as mentioned above, and therefore will not be described repeatedly. The tension adjuster 90 causes the sixth conveying roller 28 to be vertically displaced in accordance with the reciprocating motion of the oscillating frame 60, and also rocks the support frames 46A, 46B to impart a given tension F to the first conveyor belt 20.

Referring to FIGS. 11 to 13, immediately before the lower end of the oscillating frame 60 reaches the reversal position P1 at a given reciprocating rate, the abutments 61C, 61D on the frame 60 abut against the rods 78C, 78D of the third air cylinders 78A, 78B, whereby these rods 78C, 78D instantaneously reduces the reciprocating rate of the oscillating frame 60. When the oscillating frame 60 reaches the reversal position P1 (dead center), the third air cylinders 78A, 78B immediately operate the rods 78C, 78D to project forward, thus imparting the force F2 which urges the oscillating frame 60 in the reversal direction. The force F2 urges the frame 60 in the reversal direction while overcoming the rising speed of the reciprocating mechanism 70, which is therefore accelerated to allow the reciprocating mechanism 70 to restore its reciprocating rate rapidly.

Similarly, immediately before the lower end of the frame 60 reaches the reversal position P3, the abutments 62C, 62D on the frame 60 abut against the rods 77C, 77D of the remaining third air cylinders 77A, 77B to reduce the reciprocating rate of the frame 60 instantaneously. When the frame 60 reaches the reversal position P, the third air cylinders 77A, 77B operate the rods 77C, 77D immediately to project forward, imparting the force F2 which urges the frame 60 in the reversal direction. Accordingly, the mat material M which is discharged from the discharge end of the first and the second conveyor belt 20, 30 will be discharged at a given discharge rate during the reversal of the oscillating frame 60, and because it is pulled with a force Fm of a given magnitude in the reversal direction and then rapidly restores its reciprocating rate, the edges in the folded areas will be folded upon itself in good agreement with the width of the stroke of the oscillating frame 60 to achieve an even surface density over the entire mat during the accumulation. It will be noted that by combining both the first and the second accelerating mechanism 13A, 13B, the time required for the oscillating frame 60 to restore its reciprocating motion can be further reduced.

Figure 16:
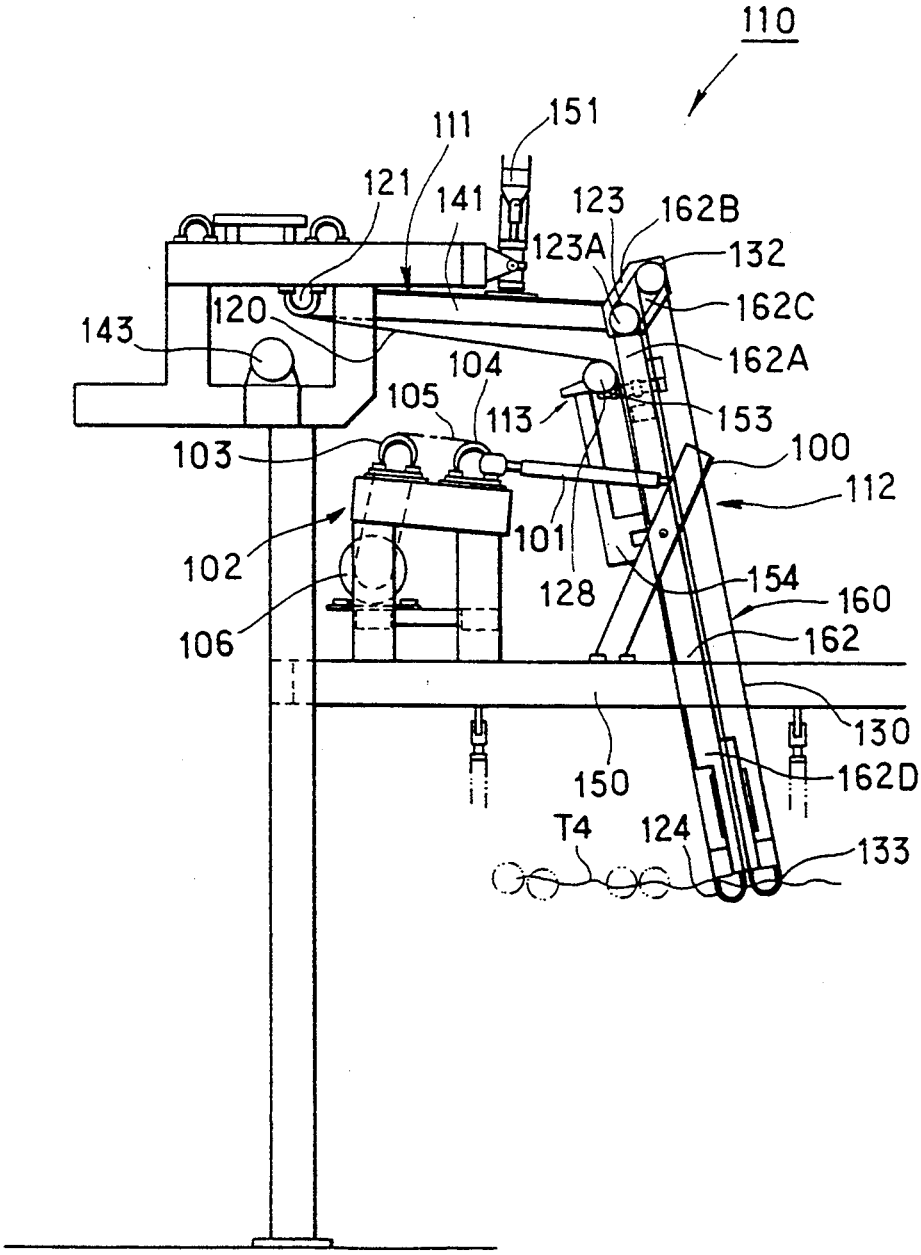
FIG. 16 is a side elevation of another embodiment of the invention.
Figure 17:
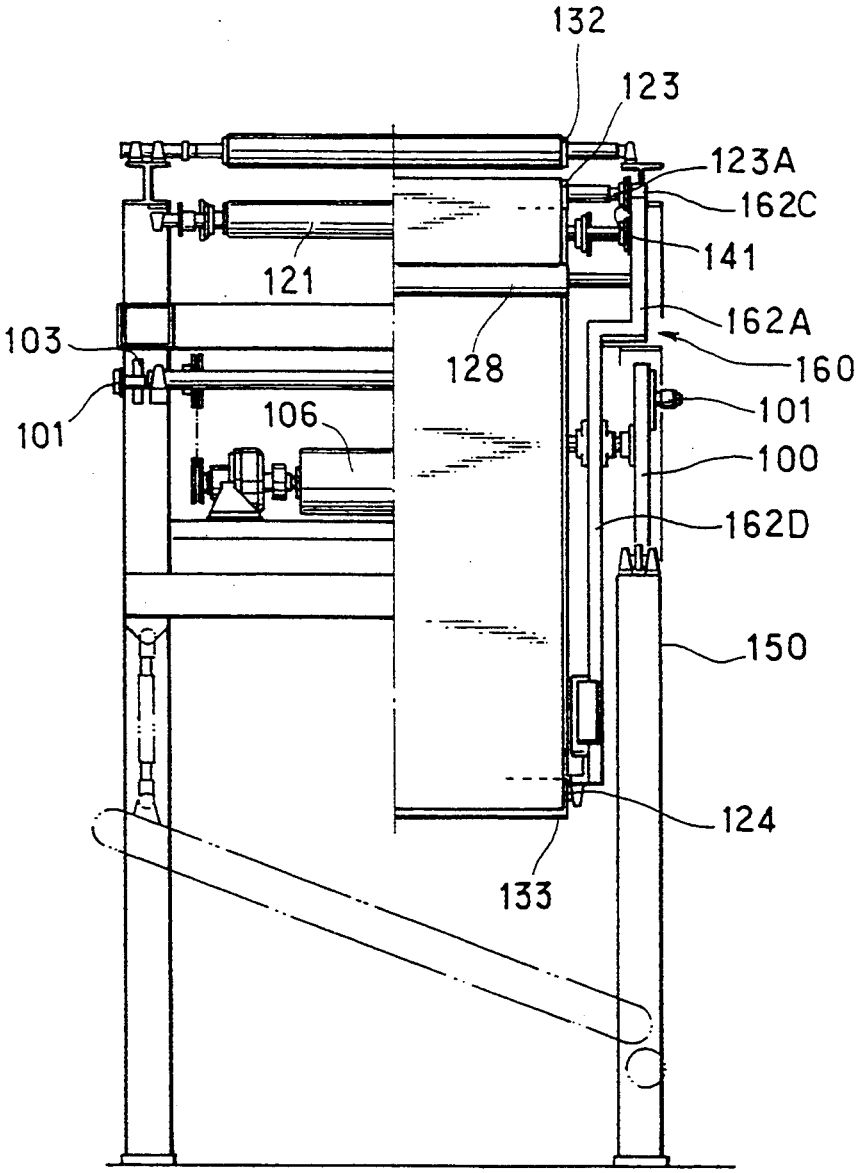
FIG. 17 is a front view, partly in section, of part shown in FIG. 16.
Figure 18:
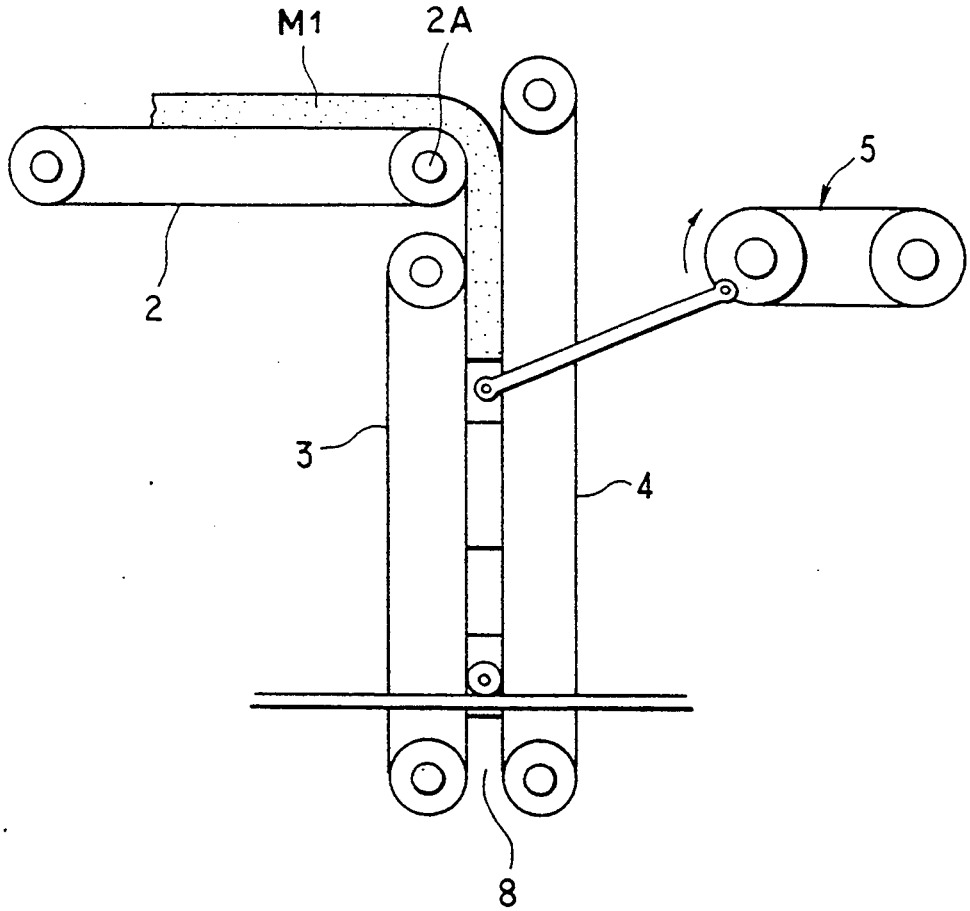
FIG.18 PRIOR ART
FIG. 18 is an illustration of an essential construction of a conventional piled-up cotton mat manufacturing apparatus.
Figure 19:
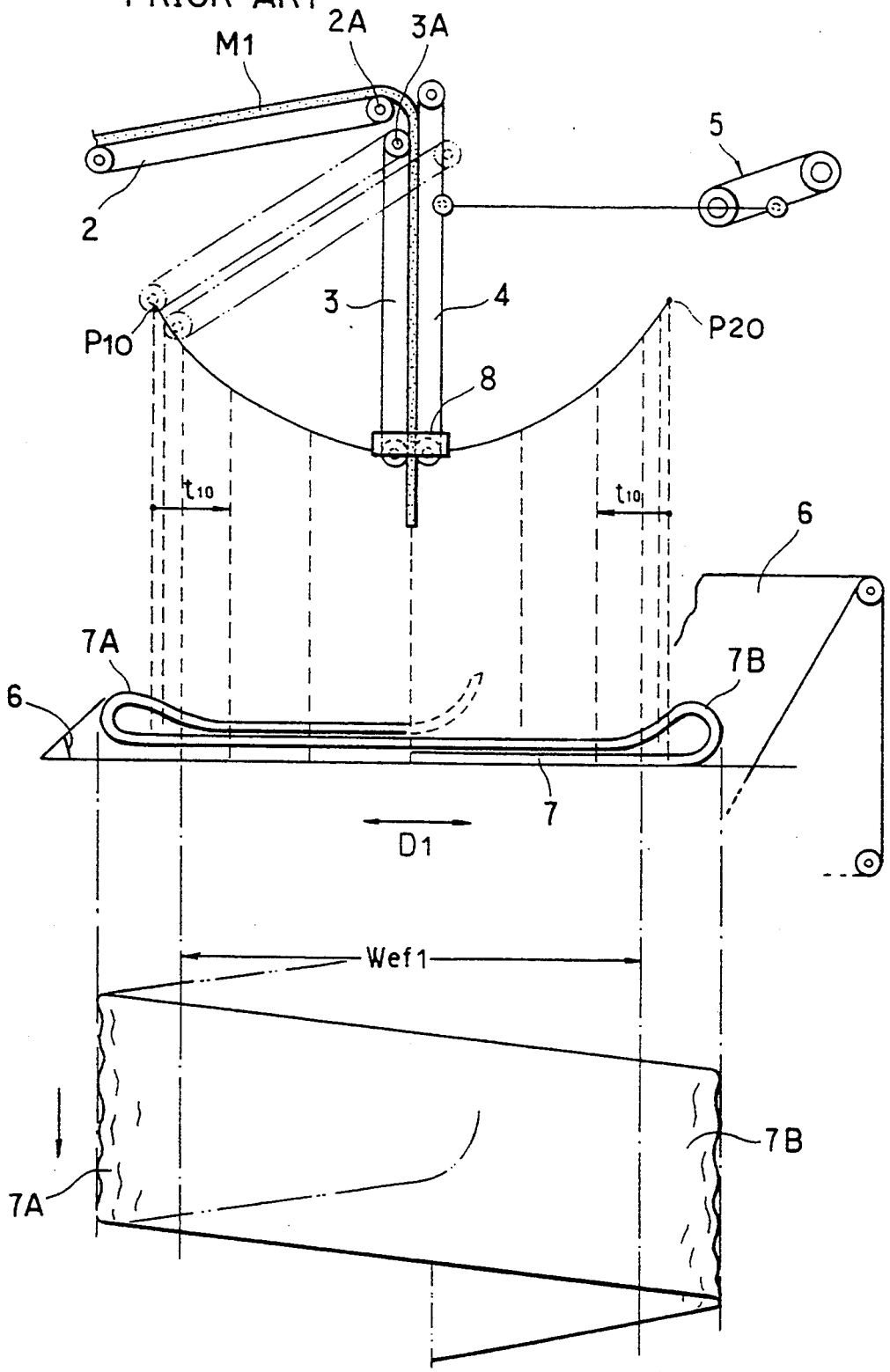
FIG.19 PRIOR ART
FIG. 19 is a schematic illustration of the forming of cotton from a mat material which takes place according to the conventional apparatus shown in FIG. 18.

FIGS. 16 and 17 shown an apparatus 110 for manufacturing a piled-up cotton mat according to another embodiment of the invention. The apparatus 110 comprises a conveying mechanism 111, an oscillating mechanism 112 and an accelerating mechanism 113. As shown in FIG. 16, the conveying mechanism 111 comprises a first drive roller 121, a first conveying roller 123 and a second conveying roller 124, around which a first conveyor belt 120 extends, and also comprises a second drive roller 132 and a third conveying roller 133, around which a second conveyor belt 130 extends. The first drive roller 121 is rotatably journalled on a pedestal 150, and is driven for rotation by a motor 143. The first conveying roller 123 is rotatably mounted on the free end of a support frame 141 while the second conveying roller 124 is rotatably mounted on the lower end of an oscillating frame 160. The support frame 141 is mounted on the pedestal 150 so as to be rockable about the axis of the first drive roller 121 by means of air cylinders 151. The second drive roller 132 is rotatably journalled on the top end of the oscillating frame 160, and a rotating drive from the first drive roller 121, as reversed, is transmitted thereto through a chain, not shown.

Referring to FIG. 16, the oscillating mechanism 112 comprises the oscillating frame 160, an oscillating rod 100, a crankshaft 101 and a drive unit 102. As shown in FIG. 17, the oscillating frame 160 comprises a pair of frames 161, 162 which are spaced apart in the flow direction (only frame 162 is shown in FIGS. 16 and 17, and frame 161 is omitted from illustration), and each frame 161, 162 is suspended from a shaft 123A of the first conveying roller 123 so as to be oscillatable. As shown in FIG. 16, each frame 161, 162 includes an upper portion 161A, 162A, the top end of which is formed with a bevelled portion 161B, 162B in which a cam groove 161C, 162C is formed. In addition, each frame 161, 162 has a lower portion 161D, 162D which is inwardly offset from the upper portion 161A, 162A.

The shaft 123A of the first conveying roller 123 extends through the cam grooves 161C, 162C, whereby the oscillating frame 160 is mounted for oscillating motion about the fulcrum defined by the shaft 123A, and is also vertically movable relative to the shaft 123A by an amount corresponding to the length of the cam groove 161C, 162C. Referring to FIGS. 16 and 17, rocking rods 100 have their one end rockably mounted on the pedestal 150 while the other ends are pivotally connected with the oscillating frame 160 at its substantially central portions 161D, 162D. Referring to FIG. 16, the drive unit 102 is mounted on the pedestal 150, and is connected to rocking rods 100 through crankshafts 101. The drive unit 102 includes chains 105 extending around spaced sprockets 103, 104, which are driven by a motor 106. The crankshafts 101 have their one end connected to the chains 105 and the other end connected to the upper portion of the rocking rods 100, thus translating a drive from the drive unit 102 into a reciprocating motion which is transmitted to the rocking rods 100.

Referring to FIG. 16, the accelerating mechanism 113 comprises a first urging roller 128, and air cylinders 153 which urges the first urging roller 128 against the outer surface of the first conveyor belt 120. The air cylinders 153 are mounted on support plates 154 which are mounted on the upper portions 161A, 162A of the respective frames 161, 162. As the air cylinder 153, 153 causes a reciprocating motion of the associated rods, the first urging roller 128 adjusts the magnitude of the force with which it bears against the outer surface of the first conveyor belt 120. During the reversal of the oscillating frame 160, it imparts a given tension to the first conveyor belt 120, thereby accelerating the rising speed of the discharge end from the first conveyor belt 120 and the second conveyor belt 130, which is defined by the lower end of the oscillating frame 160.

A method of manufacturing a piled-up cotton mat using the apparatus shown in FIGS. 16 and 17 will now be described. In the apparatus 110, the conveying mechanism 111 and the oscillating mechanism 112 are driven by the motors 143, 106, respectively. The drive from the motor 143 is transmitted to the first drive roller 121, which is then driven for rotation in the flow direction or clockwise as viewed in FIG. 16, whereupon the first conveyor belt 120 begins to run in a direction from the first drive roller 121 toward the first conveying roller 123 and the second conveying roller 124. On the other hand, a drive from the motor 143 is transmitted to the second driver roller 132 through a transmission mechanism, not shown, and is driven for rotation in the opposite direction from the first drive roller 121. Accordingly, the second conveyor belt 130 runs in the opposite direction from the first conveyor belt 120. When a mat material M is introduced onto the first conveyor belt 120 from an external conveying path, the mat material M will be conveyed in the flow direction of the first conveyor belt 120, and is then held between the second conveyor belt 130 and the first conveyor belt 120 to be conveyed downward at a given discharge rate. Finally, the mat material M is discharged from the discharge end defined between the second conveying roller 124 and the third conveying roller 133 at the lower end of the oscillating frame 160.

When the sprocket 103 is driven for rotation by the drive from the motor 106, the chains 105 run across the sprockets 103, 104, whereby the crankshafts 101 reciprocate to cause an oscillating motion of the oscillating frame 160 through the rocking rods 100. At this time, the oscillating frame 160 will be oscillated about the fulcrum defined by the shaft 123A of the first conveying roller 123, but because the rocking rods 100 are pivotally connected to the lower portions 162D of the oscillating frame 160 and the support frame 141 are vertically rocked by the air cylinders 151, the trajectory T4 of movement of the lower end of the oscillating frame 160 will depict a substantially horizontal trajectory T4 as illustrated in FIG. 16, and the displacement of the oscillating frame 160 in the vertial direction is absorbed by the vertical movement of the shaft 123A of the first conveying roller 123 within the cam grooves 161C, 162C.

Upon reversal of the oscillating frame 160, the air cylinders 153 of the accelerating mechanism 113 are operated in synchronism with each other, thus pressing the first urging roller 128 against the outer surface of the first conveyor belt 120, thereby imparting a given tension F3 to the first conveyor belt 120. Accordingly, upon reversal of the discharge end from the first conveyor belt 120 and the second conveyor belt 130, defined by the lower end of the oscillating frame 160, a force represented by a horizontal vector acting in the reversal direction is applied to the second conveying roller 124, thus accelerating the rising speed until the reciprocating rate is restored. Accordingly, the mat material M which is discharged from the discharge end of the first and the second conveyor belt 120, 130 is delivered at a given discharge rate during such reversal and because it is pulled in the reverse direction with a force Fm of given magnitude and then restores its reciprocating rate, the folded areas are folded upon itself upon the mat in good agreement with the width of the stroke of the oscillating frame 160 for an even accumulation.

As described above, in accordance with the invention, the rising speed from the reversal of the discharge end of the mat material is accelerated until the reciprocating rate is restored to provide a smooth and rapid diversion or inversion to achieve an even distribution of the edge of the piled-up mat being collected across the width or in the traverse direction while simultaneously achieving an even surface density across the entire piled-up mat. In this manner, the amount of edge trimming from the folded areas can be reduced, thereby increasing the proportion of the effective width across the entire piled-up mat to reduce the manufacturing cost.

While the invention has been disclosed above in connection with several embodiments thereof, it should be understood that a number of changes, modifications and substitution therein will readily occur to one skilled in the art from the above disclosure without departing from the spirit and scope of the invention defined by the appended claims.

I claim:

1. A method of manufacturing a piled-up cotton mat including the steps of delivering a mat material which is continuously supplied through first conveying means to second conveying means which includes a conveyor belt, conveying the mat material at a given rate while holding it sandwiched within the second conveying means, oscillating the second conveying means at a given oscillating rate about a fulcrum defined on a downstream point on the first conveying means to discharge the mat material from the oscillating end of the second conveying means in a traverse motion for accumulating it on a running forming conveyor while folding it upon itself; and the further steps of accelerating the oscillating end by imparting a tension to the conveyor belt of the second conveying means during a reversal of the oscillating end for a time interval from a dead center of the oscillating motion until the oscillating rate is restored to thereby increase a rising speed, and pulling a folded area of the mat material in a reversal direction when the mat material is folded upon itself during the reversal of the oscillating end.

2. A method according to claim 1 in which a folded area of a piled-up mat is pulled in a manner such that an even edge width of the piled-up mat is formed in the traverse direction and an even surface density is achieved across the entire piled-up mat during the reversal of the oscillating end.

3. A method according to claim 1 in which the oscillating end of the second conveying means is caused to reciprocate in a horizontal direction.

4. An apparatus for manufacturing a piled-up cotton mat comprising first conveying means for conveying a mat material which is continuously supplied, second conveying means for conveying the mat material as delivered from the first conveying means in a manner holding it sandwiched therein, and oscillating means for causing the second conveying means to oscillate about a fulcrum defined by a downstream point on the first conveying means, thereby discharging the mat material from an oscillating end of the second conveying means in a traverse motion for accumulation on a running forming conveyor while folding it upon itself; and accelerating means for accelerating the oscillating end for a time interval from a dead center until the oscillating rate is restored, thereby increasing a rising speed, wherein said first conveying means includes an upstream and a downstream roller, wherein said second conveying means includes a pair of upstream and downstream rollers which are spaced apart by a given spacing, further including a first conveyor belt extending around the respective rollers of the first conveying means and one roller of each of the pair of upstream and downstream rollers of the second conveying means, and a second conveyor belt extending around the other roller of each pair of the upstream and the downstream rollers of the second conveying means, the first and the second conveyor belts being driven in opposite directions; from each other to form a conveying mechanism which conveys a mat material, and in which the accelerating means comprises a tension adjuster which imparts a tension to at least one of the conveyor belts to produce a horizontal vector acting in a reversal direction which is applied to the oscillating end.

5. An apparatus according to claim 4 in which the oscillating means comprises a reciprocating mechanism which causes the oscillating end of the second conveying means to reciprocate in the horizontal direction.

6. An apparatus according to claim 5 in which the reciprocating mechanism adjustably controls a position where a reversal of the oscillating end occurs, thereby providing a variable stroke of reciprocating motion.

7. An apparatus according to claim 4 in which the downstream roller of the first conveying means and one of the upstream rollers of the second conveying means comprises an integral fulcrum roller.

8. An apparatus according to claim 4 in which the tension adjuster comprises an urging unit which urges against a return run of the first conveyor belt to cause an elongation of the first conveyor belt, and an elevator which causes the first conveying means to rock about a fulcrum defined by a portion of the first conveying means in response to the oscillating motion of the second conveying means.

9. An apparatus according to claim 8 in which the urging unit comprises an urging roller which bears against the first conveyor belt, and a first cylinder unit on which the urging roller is pivotally mounted and which causes the urging roller to produce an elongation in the first conveyor belt.

10. An apparatus according to claim 9 in which the first cylinder unit pivotally mounts the urging roller in a manner to cause it to abut against the inner surface of the first conveyor belt, thereby causing an elogation of the first conveyor belt in the outward direction.

11. An apparatus according to claim 9 in which the first cylinder unit pivotally mounts the urging roller in a manner to cause it to bear against the outer surface of the first conveyor belt, thereby causing an elogation of the first conveyor belt in the inward direction.

12. An apparatus according to claim 8 in which the elevator causes a seesaw motion of the first conveying means about a fulcrum which is defined by an intermediate point on the first conveying means in response to the oscillating motion of the second conveying means.

13. An apparatus according to claim 12 in which the elevator comprises a second cylinder unit which is connected to the first conveying means through a rod.

14. An apparatus according to claim 8 in which the elevator causes a rocking motion of the first conveying means about a fulcrum defined by the upstream roller of the first conveying means in response to the oscillating motion of the second conveying means.

15. An apparatus according to claim 4 in which the accelerating means comprises an accelerator which imparts a force which urges the oscillating end in the reversal direction.

16. An apparatus according to claim 15 in which the accelerator comprises an air cylinder.

* * * * *